United States Patent [19]

Hoover et al.

[11] 4,284,244

[45] Aug. 18, 1981

[54] PROCESS FOR PRODUCING HIGH GRADE MOLYBDENUM DISULFIDE POWDER

[75] Inventors: Maurice R. Hoover, Florham Park, N.J.; Deepak Malhotra, Lakewood; Fredrick N. Bender; Richard A. Ronzio, both of Golden, all of Colo.

[73] Assignee: Amax, Inc., Greenwich, Conn.

[21] Appl. No.: 76,866

[22] Filed: Sep. 19, 1979

[51] Int. Cl.[3] ..... B02C 23/08

[52] U.S. Cl. ..... 241/24; 209/5; 209/18; 209/166; 423/561 R

[58] Field of Search ..... 209/5, 3, 10, 45, 47, 209/49, 166, 9, 18; 241/20, 24, 14; 134/25.1, 25.5; 423/53, 561 R; 252/25

[56] References Cited

U.S. PATENT DOCUMENTS

| | | | |
|---|---|---|---|
| 763,259 | 6/1904 | Cuttermole | 209/49 |
| 1,421,862 | 7/1922 | Trent | 209/49 |
| 2,113,727 | 4/1938 | Hull | 209/49 X |
| 2,845,936 | 8/1958 | Boynton | 134/255 X |
| 3,045,818 | 7/1962 | Muschenhorn | 209/5 X |
| 3,230,282 | 1/1966 | Campagne | 209/5 X |
| 3,268,071 | 8/1966 | Puddington | 209/5 |
| 3,298,617 | 1/1967 | Engel | 209/166 X |
| 3,307,790 | 3/1967 | Cohn | 209/166 X |
| 3,401,794 | 9/1968 | Furnand | 209/5 |
| 3,572,500 | 3/1971 | Kouloberis | 209/5 |
| 3,919,079 | 11/1975 | Weston | 209/3 X |
| 4,083,921 | 4/1978 | Wesely | 423/53 X |
| 4,089,776 | 5/1978 | McMurray | 209/5 |

FOREIGN PATENT DOCUMENTS

| | | | |
|---|---|---|---|
| 47-9669 | 7/1972 | Japan | 241/24 |

*Primary Examiner*—Robert Halper

*Attorney, Agent, or Firm*—Harness, Dickey & Pierce

[57] ABSTRACT

A process for producing a high grade molybdenum disulfide powder suitable for use in the formulation of chemicals and as an intermediate for synthesizing high purity molybdenum compounds by which an impure particulated molybdenite concentrate feed material is pulverized and thereafter is subjected to a plurality of purification treatments to effect a progressive extraction of the contaminating mineral constituents entrapped within the molybdenite particles. The purification treatments comprise a wash treatment of the molybdenite concentrate containing up to 10% by weight of hydrocarbon oil employing an aqueous solution forming a slurry which is subjected to successive steps of high shear agitation and low shear agitation to break up the agglomerated molybdenite particles and to effect a release of the mechanically entrapped very fine mineral particles which remain suspended in the aqueous liquid phase. At the completion of the high and low shear treatment, the slurry is transferred to a separator in which the agglomerated molybdenite particles are extracted from the predominant portion of the liquid phase which contains a substantial proportion of the released mineral contaminants. The molybdenite concentrate and the aqueous wash solution are transferred through the plurality of purification treatments in a countercurrent fashion. The resulting agglomerated molybdenite concentrate, free of the contaminants, is then subjected to regular froth flotation to remove any coarse contaminants.

11 Claims, 5 Drawing Figures

PROCESS FOR PRODUCING HIGH GRADE MOLYBDENUM DISULFIDE POWDER

BACKGROUND OF THE INVENTION

Molybdenum disulfide concentrates of relatively high grade have long been recognized and employed as an intermediate for synthesizing a variety of molybdenum compounds, as well as metallic molybdenum itself, which are of a corresponding high purity. Such high grade molybdenum disulfide concentrates consist of particles containing contaminating constituents which consist essentially of minerals such as potassium minerals, silica, silicates and other gangue constituents present in the original ore body from which the molybdenite is derived. Chemical feed stock or other high grade molybdenite powders normally contain less than 1.5% contaminants.

Molybdenum disulfide powders of the requisite high purity have heretofore been produced in accordance with prior art practices by subjecting an impure particulated molybdenite concentrate to a plurality of grinding, flotation and extraction operations to effect a progressive reduction in the quantity of contaminating constituents therein. While processes of the foregoing type have been successful for producing powders of satisfactory purity, the purification technique requires relatively large capital investment in equipment, is relatively costly to operate, is inefficient in removing contaminating mineral constituents, such as potassium minerals, from the concentrate, and produces a powder product in less than optimum yields based on the feed material processed.

In order to overcome the relatively high costs associated with the foregoing physical purification technique, a variety of chemical purification processes have heretofore been used or proposed, such as described in U.S. Pat. Nos. 2,686,156; 3,101,252 and 3,661,508. Such chemical purification techniques as described in the aforementioned patents have been effective to produce high purity molybdenum disulfide powders but have not overcome the problems associated with physical purification techniques; namely, the relatively high costs, complexity and capital expenditure in the practice of the purification process. Moreover, such chemical purification techniques require the use of substantial quantities of high cost chemical reagents and further require the use of waste treatment facilities for treatment of the effluents in order that they can harmlessly be discharged to waste.

The present process provides for a physical purification of impure molybdenite concentrate feed materials which overcomes many of the disadvantages and objections associated with prior art techniques, providing for improved efficiency in the removal of insoluble contaminating constituents, including potassium minerals; while at the same time, minimizing losses of the molybdenite constituent, providing a high purity product in comparatively high yields.

SUMMARY OF THE INVENTION

The benefits and advantages of the present invention are achieved by a process for purifying a relatively impure molybdenite concentrate, such as derived, for example, from an oil froth flotation beneficiation process of a molybdenite ore. Such concentrates comprise oil agglomerates of finely divided smaller molybdenite particles. The impure molybdenite concentrate is subjected, if necessary, to a further grinding or pulverizing step to reduce its maximum particles size to a required high degree of liberation between the molybdenite and gangue components, whereafter the pulverized feed material containing up to about 10% hydrocarbon oils is pulped with water to form a slurry of relatively high solids content, which is introduced into the first of a plurality of purification treating steps. In each purification stage, the feed material is admixed with an aqueous solution and is subjected to high shear agitation in a manner to break up the oil agglomerates of molybdenite so as to release the extremely fine-sized non-oil wettable particulate contaminants, such as silica, mineral contaminants and potassium mineral contaminants which become suspended in the liquid phase. The agitated mixture thereafter is introduced into a separation chamber so as to effect a reagglomeration of the molybdenite particles while retaining the substantial proportion of released contaminating non-oil wettable mineral particles in suspension in the liquid phase. The reagglomerated molybdenite particles are thereafter separated from the predominant portion of the liquid phase containing the contaminants suspended therein and the concentrated slurry of molybdenite feed material is transferred and introduced to the next purification treatment while the separated liquid phase is transferred to the preceding purification treatment stage and ultimately is discharged to tails from the first purification stage. The aqueous wash solution passes in a countercurrent fashion relative to the molybdenite concentrate feed material and becomes progressively loaded with fine-sized suspended mineral and gangue constituents, while the molybdenite concentrate progressively increases in purity as the contaminating constituents are removed during each successive purification stage. Ordinarily, three successive countercurrent purification treatments are adequate to effect an upgrading of a molybdenite concentrate feed material containing up to about 10% contaminants by weight, to a high purity molybdenum disulfide powder containing less than 1.5% residual contaminating constituents. But more than three countercurrent purification steps can be used, if required, to accomplish the desired results.

The purified powder derived from the last purification stage is preferably subjected to a final froth flotation treatment to remove any remaining coarse gangue particles, whereafter it is dried to remove substantially all of the residual water therein, providing a high purity molybdenum disulfide powder product.

DESCRIPTION OF THE PREFERRED EMBODIMENTS

Figure 1:
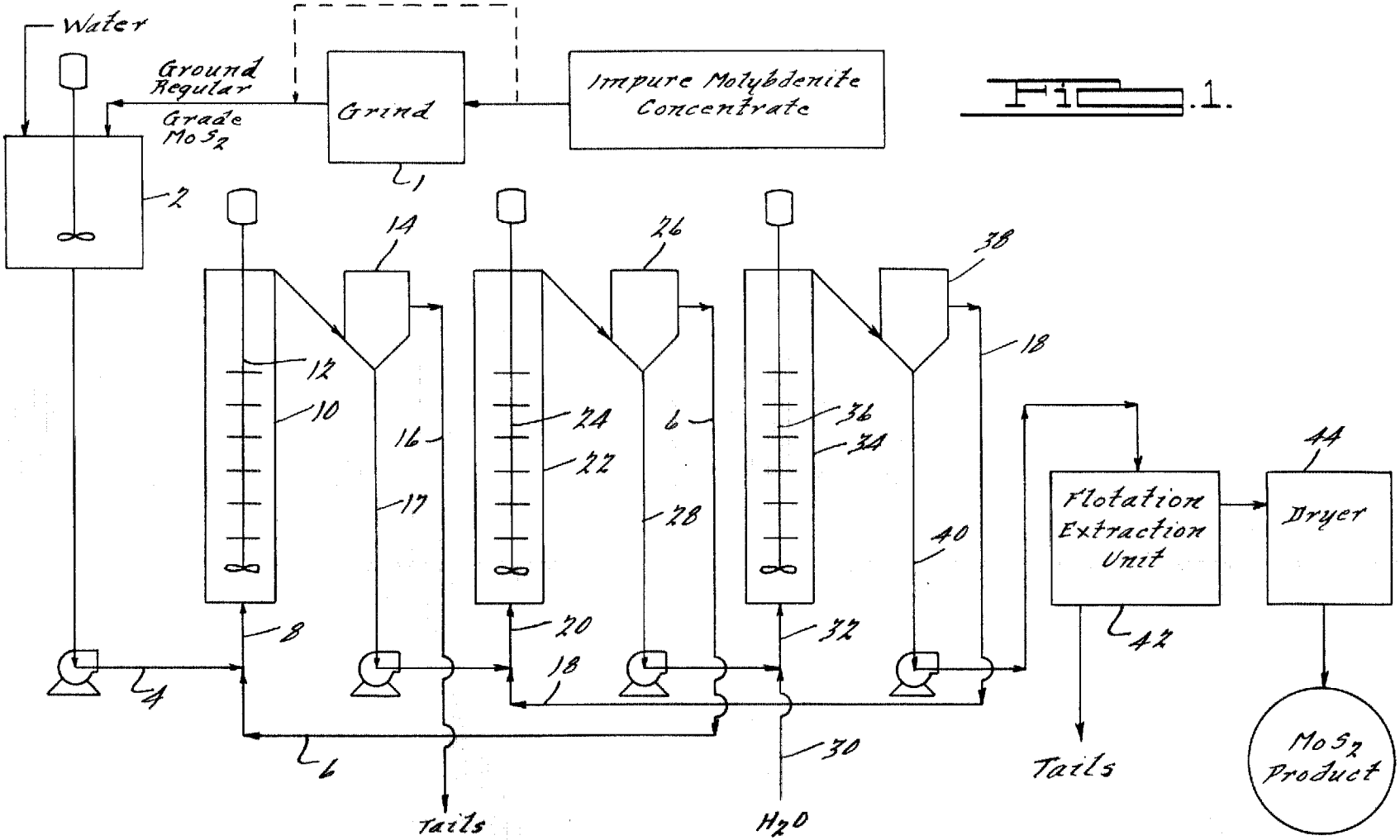
FIG. 1 comprises a flow diagram schematically depicting the sequence of steps in the practice of the process in accordance with one embodiment of the present invention.

The description of the composition of the feed material and the purified product, as well as the concentration of the slurries employed, are expressed in the specification and subjoined claims in terms of percentages by weight unless clearly indicated to the contrary.

The feed material to the purification process of the present invention may comprise any particulated molybdenite concentrate which is composed predominantly of molybdenum disulfide which is derived from any one of a number of commercial sources. The molybdenite concentrate feed material may be derived from the beneficiation of molybdenite ore, in which case the concentration of contaminating substances is usually between 5% to 10% by weight. The contaminating constituents in the concentrate comprise silica, silicates, clays and other contaminating gangue constituents normally found in the original ore body which are usually classified as "insolubles" and are normally identified as that portion of the concentrate which is insoluble in nitric acid and perchloric acids while soluble in hydroflouric acid.

A principal source of molybdenite ores is at Climax, Colo., in which molybdenite ($MoS_2$) is found in an ore body consisting of a highly silicified and altered granite, through which molybdenite is distributed in the form of very fine-sized veinlets. The concentration of the molybdenite in the ore as mined usually ranges from about 0.3% to about 0.6%. The concentration of the molybdenite is increased through various beneficiation processes, of which a froth flotation extraction process is particularly satisfactory for increasing the concentration of the molybdenum disulfide constituent to levels in excess of about 60%, and more usually to levels of 90% or greater, providing a so-called regular or technical grade concentrate.

The froth flotation beneficiation operation is carried out in a series of successive flotation cycles including one or more intervening grinding operations, whereby the ore is progressively reduced in particle size to expose the molybdenite constituent for extraction. The flotation extraction operation utilizes a hydrocarbon oil and pine oil in combination with various other reagents, whereby the particles rich in molybdenum disulfide are rendered hydrophobic and are oil coated and retained in the flotation froth, whereas the gangue particles, composed predominantly of silica, remain in the tailing portion of the pulp. The oily substance employed in the oil flotation extraction process may comprise any one of a variety of hydrocarbon substances which become adsorbed on the molybdenum disulfide particles and usually comprise mixtures of vegetable and/or petroleum oils of the general type as disclosed in U.S. Pat. No. 2,686,156, the substance of which is incorporated herein by reference.

The repeated grinding operations to which the ore is subjected during the flotation extraction operation effects a reduction in particle size of the resultant molybdenite concentrate to achieve about 90% liberation or greater. The number of specific extraction cycles performed will vary depending upon the purity desired in the recovered concentrate. In accordance with the preferred practice of the present invention, the oil flotation beneficiation process is performed until the contaminating constituents are less than about 10% by weight, and more usually, from about 5% to about 6%, which comprise regular or technical grade molybdenite concentrates. In order to produce chemical feed or high grade concentrates from regular grade concentrates, employing physical purification techniques, it has heretofore been necessary to subject such regular grade concentrates to additional grinding operations and additional froth flotation extraction cycles in order to reduce the mineral contaminants from a level of about 10% to a level of about 1.0% or less. It is commercially impractical to attempt to reduce the level of contaminants to below about 0.35% employing the froth flotation extraction process. In accordance with the present invention, the regular grade concentrate is purified employing a series of countercurrent wash cycles in which the mineral contaminants are removed, producing a molybdenum disulfide powder product containing less than about 1% by weight of hydrophylic mineral contaminants.

The feed material to the purification process comprises a molybdenite concentrate containing about 90% molybdenite on a dry oil-free basis, such as derived from the previously described oil flotation beneficiation process. Generally, concentrates of that type contain up to about 20% water and up to about 7% residual flotation oils. The presence of such residual flotation oils is essential in the practice of the present process to effect a coalescence and agglomeration of the molybdenum disulfide particles during the high shear agitation wash treatment. The oily substances present effect a preferential wetting of the surfaces of the molybdenum disulfide particles and facilitate an agglomeration into large-sized particles which settle rapidly, enabling their separation from the liberated relatively fine-sized hydrophylic mineral contaminants, which remain suspended in the aqueous wash solution. Residual flotation oil contents of about 5% to about 7% present in the feed material derived from an oil flotation beneficiation process usually provide adequate agglomeration of the molybdenum disulfide particles. When the feed material is of a relatively fine particle size, such as, for example, as small as about 5 microns, the addition of supplemental hydrocarbon oils to provide oil concentrations of up to about 10% may be desirable in order to compensate for the increased surface are of such fine-size feed materials. In such instances in which the molybdenite concentrate is derived from sources other than an oil flotation beneficiation process, wherein it is substantially devoid of any residual flotation oils, it is necessary to add oil to the feed material to provide a concentration generally in the range of about 1% up to about 10%, depending upon the particle size of the feed material. The oil substance added may comprise any hydrocarbon oil of medium or low viscosity or of the general types disclosed in the aforementioned U.S. Pat. No. 2,686,156.

The degree of comminution of the feed material is controlled so as to effect a liberation of the contaminating quartz, silicates and other gangue components from the feed material during the high shear agitation wash treatment. The specific average particle size and maximum particle size of the feed material will vary in consideration of the type, quantity and form of such entrapped insoluble contaminating constituents. Certain minerals, such as galena, sometimes are present in an extremely fine particle size and are more difficult to reject because of difficulties to obtain a high degree of liberation of the galena particles, in comparison to such other gangue components as quartz and silicates, for example. When conventional molybdenite concentrates are employed as the feed material, it is usually necessary to subject such concentrates to further comminution, preferably by a high attrition-type grinding machine, such as, for example, a sand grinder, a vibratory mill, or pebble mills to effect a reduction in its particle size to a plus 99% liberation between molybdenite and gangue components.

The term "liberation" or "degree of liberation" as herein employed is used in accordance with established mineral technology. A technical discussion of this term and the effect of grinding or pulverizing on the liberation of the particles in an ore is contained in a technical book entitled "Flotation" by A. M. Gaudin, Second Edition, 1957, available from McGraw-Hill Book Company, Inc. and particularly, pages 404 through 412 thereof. For further details, reference is made to the aforementioned treatise, the substance of which is incorporated herein by reference.

The molybdenite concentrate feed material is first pulped with water to form a slurry having a solids concentration of about 5% up to a level above which difficulty is encountered in pumping the slurry to the first purification stage. The pulping operation is performed employing agitation so as to provide a substantially homogeneous slurry, facilitating its pumping and introduction in the form of a uniform suspension into the first mixing tank. When the molybdenite feed material is derived directly from an oil flotation beneficiation operation, the feed material ordinarily is in the form of an agitated slurry and can be transferred directly by pumping to the first mixing tank, obviating the need of a separate pulping tank.

Referring now in detail to FIG. 1 of the drawings, the molybdenite concentrate feed material derived from the oil flotation extraction of a molybdenite ore, is subjected to further grinding, if necessary, in a grinding apparatus 1, and thereafter is slurried with water in a pulping tank indicated at 2. The slurry is transferred via a pump and conduit 4 and is admixed with a controlled amount of an aqueous wash solution in a conduit 6, which are concurrently introduced through a conduit 8 into the lower portion of a first stage mixing tank 10. The mixing tank 10, as shown schematically, is equipped with a high speed agitator 12 for subjecting the mixture of the aqueous wash solution and slurry to a high shear agitation as it moves upwardly through the interior of the mixing tank. The high shear agitation of the mixture is important to effect a break up of the particle agglomerates, effecting an exposure and release of the entrapped very fine-sized contaminating constituents, which become suspended in the aqueous liquid phase. The fine-sized contaminants are usually of a particle size less than about 1–5 microns and because of this, remain suspended in the liquid phase for prolonged time periods without any tendency to settle. In contrast, the molybdenite particles tend to reagglomerate rapidly into larger size particles which tend to rapidly settle in the absence of high shear agitation.

The mechanism by which the purification treatment is effected in each mixing tank is based on the molybdenum disulfide particles forming a flocculated structure as a result of the presence of the hydrocarbon oil, which preferentially wets the molybdenum disulfide particles. The flocculated particles become compacted and coalesce into agglomerates of a size which is in equilibrium between their growth tendencies and the destructive tendencies of the high shear agitation to which they are subjected. The actual size of the initial flocculated structures and final agglomerates is controlled by the high shear operating conditions present in the mixing tank. Agglomerate sizes are inversely proportional to the shear conditions predominating in the liquid media, this is, the equilibrium agglomerate size will decrease rapidly with increasing shear, and will increase with decreasing shear conditions. Agglomerate sizes are also directly proportional to percent solids and amount of hydrocarbon oil in the system.

In accordance with a preferred practice of the present invention, as shown in FIG. 1, the agitator 12 in each mixing tank is comprised of a series of discs stacked along a common rotating shaft to provide a sequence of high and low shear zones which provide for a destruction and reforming of the oil coated molybdenum disulfide agglomerated particles, thereby maximizing the probabilities of exposing and releasing the mechanically entrapped gangue particles in the form of a suspension in the water phase.

The term "high shear agitation", as herein employed, is generally based on the data as set forth in "Agitation of Liquid Systems Requiring A High Shear Characteristic", by P. L. Fondy and R. L. Bates; *A. I. Ch.E Journal, May* 1963, pages 338–342. The magnitude required is such as to effect a destruction or breakage of the agglomerates to liberate the entrapped small mineral contaminants under the specific parameters present in the mixing tank for the prescribed retention time. Any one of a variety of standard mixing impellers can be employed for this purpose and their shear effect is established as a function of impeller geometry, system geometry and power-speed relationships. Mathematically, the performance and power are adjusted to maximize the head term ($N^2D^2$) and reduce the flow ($ND^3$), and this can be achieved by employing a relatively small D/T ratio, a high speed and a small opposed blade area, [wherein D=impeller diameter; N=rpm; and T=tank diameter]. The peripheral velocity of the impeller is also a factor in the high shear characteristics of an agitator and experimental evidence presented in the aforementioned publication indicates that the final average agglomerate size is inversely proportional to the impeller peripheral speed raised to the 1.8 power and is relatively independent of impeller geometry. In accordance with the practice of the present process, plane disc-type impellers are preferred because of the minimum power required to effect agitation and wherein a peripheral speed of about 3,000 feet per minute or greater is employed.

In accordance with the arrangement shown in FIG. 1, the mixture of the wash solution and slurry containing the particulated molybdenite concentrate moves upwardly at a controlled rate in the first mixing chamber going through a sequence of high and low shear zones. The solids concentration of the particles in the mixture of the first stage mixing tank may range from as low as about 1% up to as high as about 40%, while solids concentrations of about 5% to about 15% are preferred. The diameter of the mixing tank 10, the height and the rate of through-put of the aqueous-particulated mixture is controlled so as to provide a residence time of an average of about 4 to about 20 minutes, with residence times of about 5 to about 10 minutes being particularly satisfactory. The temperature of the aqueous wash solution is not critical.

Upon attaining the upper end of the mixing tank 10 as shown in FIG. 1, the mixture is withdrawn and transferred to a separation unit or chamber 14 which preferably is in the form of a settling unit, whereupon during the quiescent dwell of the mixture therein, the reagglomerated molybdenite particles settle by gravity downwardly and are withdrawn from the bottom thereof through a conduit 17 in the form of a slurry which contains from about 75% to about 99.99% of the feed material on a solids basis. The predominant portion of the aqueous liquid phase introduced into the separation unit is withdrawn from the upper portion thereof through a conduit 16 and contains the predominant portion of the suspended mineral contaminants liberated from the feed material. The withdrawn liquid phase, after appropriate treatment, is discharged to tails.

The separation unit 14 is constructed in accordance with any one of the accepted theories for the design of classifiers or hydroseparators effecting a separation of the particles according to differences in their settling rates. Accordingly, the large agglomerated molybdenum disulfide particles behave like large particles having a high settling rate, and are removed from the bottom of the separator unit. On the other hand, the relatively small contaminating gangue particles dispersed in the water phase have a relatively slow settling rate and are consequently removed in the liquid withdrawn from the upper portion of the separation unit through the conduit 16.

The withdrawn liquid phase through conduit 16 during a typical purification of a regular grade molybdenite concentrate may contain a substantial amount of molybdenum disulfide, and accordingly, it is usually desirable to subject the withdrawn wash liquid to a suitable recovery treatment for extracting the entrained molybdenum disulfide therein. This can be conveniently and economically achieved by subjecting the withdrawn liquid to further thickening to increase the concentration thereof and reintroducing the thickened slurry in admixture with a molybdenite ore undergoing beneficiation in a froth flotation extraction process. Alternatively, the thickened slurry can be admixed with regular grade molybdenite concentrates and subjected to air roasting to form molybdenum oxide or the like.

As shown in FIG. 1 of the drawing, the partially purified molybdenite feed material in the slurry withdrawn from the separation unit 14 is transferred via conduit 17 for admixture with a wash solution supplied from a conduit 18, with the resultant mixture being introduced through a conduit 20 into the lower portion of a second mixing unit 22 equipped with a high speed high shear agitator 24. The mixture passes upwardly through the mixing tank 22 while being subjected to a high shear agitation in a manner and for the purposes previously described to effect further liberation of contaminating substances as a result of a further break up of the reagglomerated molybdenite particles. Upon passing out through the upper portion of the second mixing tank, the mixture is introduced into a second separation unit 26 where again the reagglomerated molybdenite particles settle rapidly while substantially all of the remaining liberated extremely fine-sized mineral contaminants stay suspended in the liquid phase.

The liquid phase containing the predominant portion of the liberated contaminating particles suspended therein is withdrawn through the conduit 6 and is transferred for admixture with the incoming feed material slurry for introduction into the first mixing tank 10. The reagglomerated molybdenite feed material is withdrawn in the form of a slurry from the lower portion of the separation unit 26 through a conduit 28 and is admixed with a controlled quantity of water as a wash solution supplied by a conduit 30 and the resultant mixture is introduced through a conduit 32 into the lower portion of a third mixing tank 34 equipped with a high shear agitator 36. The conditions as previously discussed in connection with the first and second mixing tanks are maintained in the third mixing chamber to effect a break up of the reagglomerated molybdenite particles, effecting still a further release of entrapped minute contaminating mineral constituents and a still further purification of the feed material. Upon passing beyond the upper end of the third mixing chamber, the mixture enters a third separation unit 38, wherein the molybdenite particles are again permitted to reagglomerate and settle rapidly to the lower portion, leaving a liquid phase containing the predominant portion of the released fine-sized mineral contaminants suspended therein. The liquid phase is withdrawn through the conduit 18 and is transferred for admixture with the partially purified molybdenite feed material from the first separator 14 for introduction into the lower portion of the second mixing tank 22. The reagglomerated and purified molybdenite feed material is withdrawn from the third separation unit 28 in the form of a slurry through a conduit 40 and is preferably subjected to further purification by a froth flotation extraction operation performed in the tank 42, as shown in the flow diagram, to effect extraction of any remaining relatively coarse gangue or contaminating particles remaining in the purified product. Under typical operating conditions, the subjection of the feed material to three countercurrent wash treatments effects an extraction of between about 80% to about 90% of the total contaminating constituents present. The relatively large-size gangue particles, however, because of their relatively high settling rate, tend to settle with the agglomerated molybdenum disulfide particles in the separation units and are retained in the slurry removed through the conduit 40 from the last separation unit 38. The predominant portion of such coarse residual contaminating particles are removed in the flotation extraction unit 42 and the resultant purified molybdenum disulfide product is thereafter transferred to a dryer 44 in which the predominant proportion of residual water is removed. The resultant purified and dried molybdenum disulfide product is of a chemical or lubricant grade, according to operating conditions, and is transferred to storage as depicted in the flow diagram comprising FIG. 1.

In accordance with the foregoing arrangement, the purified and dried molybdenite product comprises a powder generally containing less than about 1% residual insoluble contaminating substances, providing a chemical or high grade powder product. It will be appreciated that in lieu of employing three purification stages as depicted in the flow diagram, only two, as well as four or more, purification stages can be utilized employing a counterflow pattern of wash solution and feed material to produce a purified powder product of the required purity.

It is also contemplated that the aqueous wash solution employed in the mixing tanks in addition to comprising water may also include relatively small quantities of reagents to further enhance the removal of contaminating constituents during the multiple stage countercurrent wash purification treatment. Re-agents of the type which can be satisfactorily employed include various depressants and wetting agents of the various types in extensive use in ore beneficiation processes which facilitate a preferential wetting and suspension of the contaminating constituents in the aqueous phase. Typically, any depressants suitable for use in extracting pyrite, galena, chalcopyrite, etc., can be employed including nokes reagent ($P_2S_5$+NaOH) used in amounts up to one pound per ton of feed material processed; sodium ferrocyanide utilized in amounts generally ranging from about 1 to 1½ pounds per ton of feed material; and sodium cyanide, conventionally employed in amounts of about 0.05 up to about 0.25 pounds per ton of feed material. PH modifiers can also be satisfactorily employed including sodium carbonate ($Na_2CO_3$), lime (CaO), mineral acids such as sulfuric acid or caustic (NaOH) to effect an adjustment of the pH of the solution to within a range of about 8 to about 9, which provides for optimum wash treatment of the feed material. In addition to the foregoing, a gangue depressant, such as polyacrylamide, can also be advantageously employed in amounts usually of about 0.006 pound per ton. Polyacrylamides which can be satisfactorily employed are those commercially available from Nalco Chemical Co. under the brand name Nalco 1801, Separan MG200 available from Dow Chemical Company, and Superfloc 16, available from American Cyanamid.

In order to further illustrate the present invention, the following examples are provided. It will be understood that the examples are provided for illustrative purposes and are not intended to be limiting of the scope of the present invention as herein described and as set forth in the subjoined claims.

EXAMPLE I

A series of tests were conducted employing a regular grade molybdenum disulfide concentrate available from Climax Molybdenum Company having the following chemical analysis: 89.4% molybdenum disulfide, 8.86% insolubles, 0.3% potassium, 0.037% lead, 0.058% copper and 0.602% iron disulfide. The concentrate contained 6% by weight of residual hydrocarbon oil.

A laboratory-scale countercurrent wash apparatus in accordance with that schematically shown in FIG. 1 was employed incorporating three stages, each having a mixing tank of a four inch internal diameter and seventeen inches in height measured to the outlet to the settler at the upper end thereof. The agitator comprised six discs of a diameter of 3.5 inches on a shaft operating at 3800 rpm providing an agitator tip speed of about 3450 feet per minute. The apparatus further incorporated three cylindrical settling units having conical rim bottoms which were three inches in internal diameter. The first settler unit was of a height of twelve inches which the second and third settlers were nine inches high.

A microscopic analysis of the molybdenum disulfide concentrate revealed that the plus 99% molybdenum disulfide liberation rise was achieved at 15 microns and particle size analysis of the sample showed that 50% of the material was coarser than 15 microns. Further grinding was required to obtain the necessary degree of liberation. Experimental results, using a laboratory vibrating mill with ceramic grinding media showed that this degree of liberation could be accomplished by 30 minutes grinding time employing this type of grinding device.

A series of tests was conducted employing the foregoing laboratory apparatus which employed the same concentrate introduced at controlled feed rates and solids content and varying the wash water ratio. The wash water ratio is defined as the volume of wash water relative to the water in the slurry feed stream. The results obtained are set forth in Table 1.

TABLE 1

Summary of Countercurrent Wash System Test Runs

| Test No. | Feed Rates ml/Min | % Solids in Feed | Wash Water Ratio | % Recovery in Conc. Insol | % Recovery in Conc. Potassium | % Recovery in Conc. $MoS_2$ | % Grade of Wash Con. Insol | % Grade of Wash Con. Potassium | % Grade of Wash Con. $MoS_2$ | Calc. Head Assay % Insol | Calc. Head Assay % Potas. | Calc. Head Assay % $MoS_2$ |
|---|---|---|---|---|---|---|---|---|---|---|---|---|
| 1 | 190 | 4.76 | 0.48 | 39.55 | 50.51 | 99.76 | 3.17 | 0.139 | 92.89 | 7.55 | 0.259 | 87.73 |
| 2 | 200 | 6.19 | 1.37 | 19.48 | 26.63 | 98.81 | 1.42 | 0.069 | 97.86 | 6.72 | 0.239 | 91.35 |
| 3 | 210 | 6.29 | 3.92 | 8.42 | 14.08 | 90.90 | 0.73 | 0.039 | 98.64 | 7.13 | 0.226 | 88.63 |
| 4 | 185 | 4.65 | 5.47 | 6.93 | 11.09 | 69.40 | 0.74 | 0.039 | 98.68 | 6.85 | 0.226 | 91.26 |

The feed material in each of tests 1–4 as set forth in Table 1 was subjected to a preliminary 30 minute grind to achieve the stipulated degree of liberation.

Figure 2:
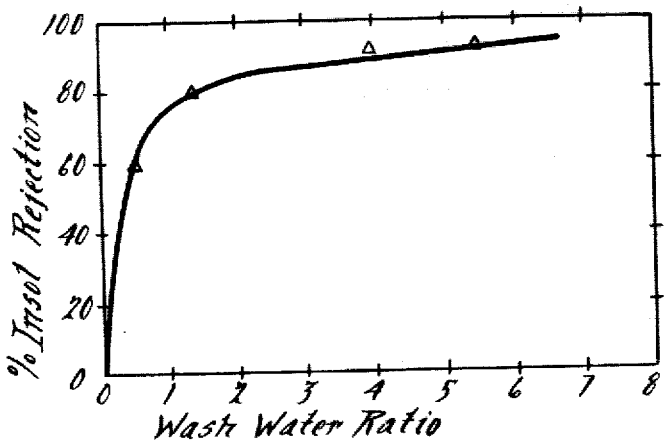
FIG. 2 is a graph depicting the percentage of insoluble contaminating particle rejection relative to the wash water ratio of a typical regular grade molybdenite concentrate.
Figure 3:
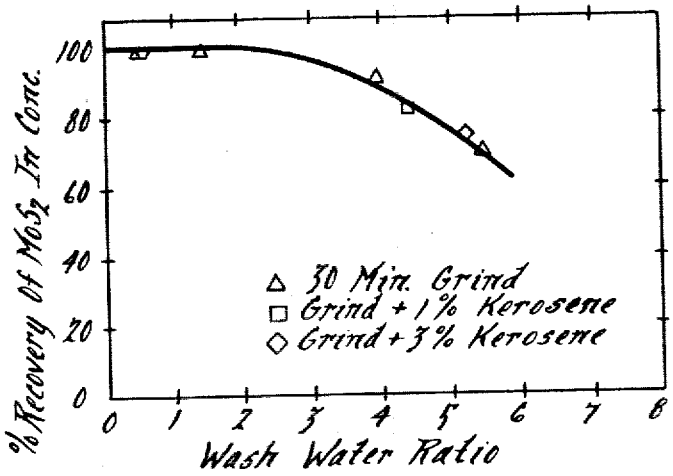
FIG. 3 is a graph depicting the percentage of recovery of molybdenum disulfide in a typical regular grade concentrate relative to the wash water ratio.

The experimental results shown in Table 1 are graphically illustrated in FIGS. 2 and 3 of the drawings. The results as set forth in Table 1 and as portrayed in FIGS. 2 and 3 clearly show that increasing the quantity of wash water employed rapidly increases the rejection of insoluble contaminating material. In the region between a wash water ratio of 2 to 3, the molybdenum disulfide recovery also drops rapidly. Consequently, the best results are obtained at wash water ratios of about 2.5 in which approximately plus 98% recovery of molybdenum disulfide and a plus 85% rejection of insolubles is obtained. This corresponds to a solids concentration of about 2.0% at a wash water ratio of 2 to a solids content of about 1% at a wash water ratio of about 3 with a solids content of about 1.5% being particularly preferred at a wash water ratio of about 2.5.

The washed and purified molybdenite concentrate product obtained from each test was subjected to a further froth flotation operation employing a laboratory cell for a total time of three minutes. The results obtained are set forth in Table 2.

TABLE 2

| Test No. | Flotation Results % Grade in Conc. Insol | % Grade in Conc. K | % Grade in Conc. $MoS_2$ | % Rec. in Conc. Insol | % Rec. in Conc. K | % Rec. in Conc. $MoS_2$ | Overall CCW + Flotation % Recovery Insol | Overall CCW + Flotation % Recovery K | Overall CCW + Flotation % Recovery $MoS_2$ |
|---|---|---|---|---|---|---|---|---|---|
| 1 | 0.918 | 0.0373 | 98.56 | 25.170 | 27.67 | 96.92 | 9.95 | 13.98 | 96.69 |
| 2 | 0.390 | 0.0287 | 99.18 | 39.185 | 49.50 | 93.08 | 7.63 | 13.18 | 92.00 |
| 3 | 0.559 | 0.0345 | 98.99 | 51.921 | 54.40 | 68.01 | 4.36 | 7.66 | 61.82 |

TABLE 2-continued

| | Flotation Results | | | | | | Overall CCW + Flotation | | |
|---|---|---|---|---|---|---|---|---|---|
| | % Grade in Conc. | | | % Rec. in Conc. | | | % Recovery | | |
| Test No. | Insol | K | $MoS_2$ | Insol | K | $MoS_2$ | Insol | K | $MoS_2$ |
| 4 | 0.4896 | 0.0392 | 98.54 | 57.921 | 63.37 | 76.11 | 4.01 | 7.03 | 52.82 |

The data as set forth in Table 2 reveal that the final purified product obtained in Test 1 is of chemical stock quality while the product obtained in accordance with Tests 2, 3 and 4 provide purified products fulfilling the requirements for a high grade molybdenum disulfide concentrate. It should be pointed out that only the results obtained in accordance with Test 2 are acceptable for producing a high grade product because of the low overall recovery of molybdenum disulfide obtained under the conditions of Tests 3 and 4.

EXAMPLE II

A molybdenum disulfide concentrate obtained as a by-product from a copper sulfide-molybdenum disulfide separation process was employed as an alternative feed material to a countercurrent wash purification system of the type illustrated in FIG. 1 and as previously described in connection with Example 1. The concentrate as originally obtained on a oil-free basis contained 54.12% molybdenum disulfide, 31.7% insolubles and 1.25% copper sulfide. The sample concentrate was first subjected to a high shear conditioning step using 1% by weight of hydrocarbon oils followed by a froth reflotation of the raw material. The upgraded concentrate was of a distribution and grade as set forth in Table 3 while the tails from the reflotation process were of a distribution and grade as set forth in Table 4.

TABLE 3

| Concentrate | | | | |
|---|---|---|---|---|
| Distribution | | | Grade | |
| WT* | $MoS_2$ | Insol | $MoS_2$ | Insol |
| 72.1 | 96.9 | 37.8 | 72.76 | 16.6 |

*WT is weight percent of feed

TABLE 4

| Tails | | | | |
|---|---|---|---|---|
| Distribution | | | Grade | |
| WT | $MoS_2$ | Insol | $MoS_2$ | Insol |
| 27.9 | 3.1 | 62.2 | 6.1 | 70.64 |

The upgraded concentrate as set forth in Table 3 was subjected to further grinding in a laboratory vibrating mill with 1% hydrocarbon oil by weight for a period of 30 minutes. The resultant reground upgraded concentrate was subjected to a countercurrent wash treatment under the same conditions as previously described in Example I. The results obtained on the purified and washed concentrate and on the tails portion of the purification process are set forth in Table 5.

TABLE 5

| Washed Concentrate | | | | |
|---|---|---|---|---|
| Distribution | | | Grade | |
| WT | $MoS_2$ | Insol | $MoS_2$ | Insol |
| 57.9 | 95.0 | 24.18 | 86.10 | 5.0 |

TABLE 5-continued

| Washed Concentrate Tails | | | | |
|---|---|---|---|---|
| Distribution | | | Grade | |
| WT | $MoS_2$ | Insol | $MoS_2$ | Insol |
| 14.2 | 5.0 | 75.82 | 18.45 | 63.82 |

The washed molybdenum disulfide concentrate according to Table 5 was thereafter subjected to, as a final step in the process, to a froth flotation purification producing a purified concentrate and tails as set forth in Table 6.

TABLE 6

| Concentrate | | | | |
|---|---|---|---|---|
| Distribution | | | Grade | |
| WT | $MoS_2$ | Insol | $MoS_2$ | Insol |
| 46.8 | 91.9 | 9.9 | 98.0 | 1.6 |

| Tails | | | | |
|---|---|---|---|---|
| Distribution | | | Grade | |
| WT | $MoS_2$ | Insol | $MoS_2$ | Insol |
| 11.10 | 8.1 | 90.1 | 35.93 | 23.47 |

The overall performance of the purification process produced a final product providing a recovery and a composition as set forth in Table 7.

TABLE 7

| Final Product | | | | |
|---|---|---|---|---|
| Overall Recovery | | | Grade | |
| WT | $MoS_2$ | Insol | $MoS_2$ | Insol |
| 46.8 | 84.6 | 1.02 | 98.0 | 1.6 |

Figure 4:
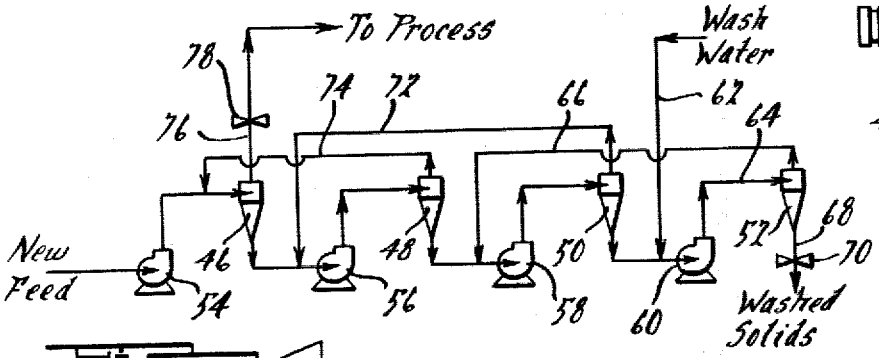
FIG. 4 is a schematic flow diagram depicting an alternative embodiment of the process of the present invention.
Figure 5:
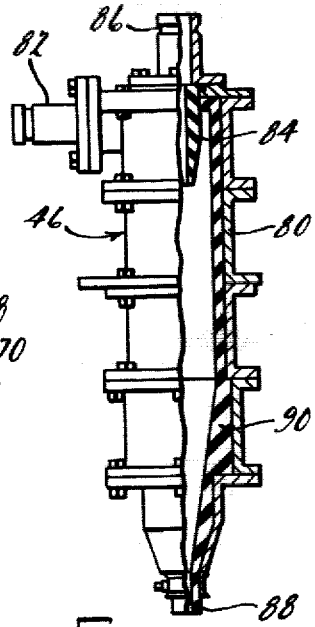
FIG. 5 is a side elevational view partly in section of a cyclone of the type employed in the apparatus schematically illustrated in FIG. 4.

Referring now in detail to FIGS. 4 and 5 of the drawings, an alternative satisfactory embodiment of the present process is illustrated in which the high shear mixing tanks of FIG. 1 are replaced with high speed centrifugal pumps and the cylindrical settlers are replaced with cyclones for providing a countercurrent wash purification of a molybdenite concentrate. The types of concentrates, their particle size and degree of liberation and the solids concentration and wash water ratios as previously described, are suitable for use in the practice of the process illustrated in FIG. 4. As shown, a series of cyclones 46, 48, 50 and 52 are connected to the discharge side of centrifugal pumps 54, 56, 58 and 60, respectively. Fresh wash water is introduced through a conduit 62 and is admixed with the cyclone underflow from the cyclone 50 and the combined streams enter the centrifugal pump 60 in which the particles are subjected to high shear agitation effecting a break-up of the particle agglomerates and an exposure and release of the entrapped fine-sized contaminating constituents which become suspended in the aqueous liquid phase. The aqueous slurry discharged from the centrifugal pump 60, passes through a conduit 64 into the cyclone 52 in which the agglomerated molybdenite particles are removed while fine-sized suspended contaminating particles remain suspended and pass through a cyclone overflow conduit 66 for admixture with the cyclone underflow discharged from the cyclone 48. The purified molybdenite particles are discharged through a cyclone underflow conduit 68 from the cyclone 52 through a throttling valve 70 and can be subjected to a further froth flotation extraction and drying operation as previously described in connection with FIG. 1 to produce a purified molybdenum disulfide product.

The wash water passes countercurrent from the cyclone 52 through the cyclone overflow conduit 66 for admixture with the feed to pump 58; from the cyclone 50 through a cyclone overflow conduit 72 for admixture with the feed pump 56; and from cyclone 48 through a cyclone overflow conduit 74 for admixture with the slurry of feed material prior to entry into the first cyclone 46. The overflow from the cyclone 46 is withdrawn through a conduit 76 equipped with a throttling valve 78 and is discharged to process.

The operation of the cyclone separators is performed employing flow rates which optimize the separation of the re-agglomerated molybdenum disulfide particles through centrifugal action from the relatively fine-sized contaminating particles liberated during the centrifugal pumping stage which as previously indicated, are usually of a particle size of from about 1 to about 5 microns. The larger size and mass of the reagglomerated molybdenum disulfide particles which generally are of a size of about 10 microns or larger are extracted through the cyclone underflow conduits while the entrained fine-sized contaminating particles are removed through the cyclone overflow conduit achieving thereby a progressive purification of the feed material as it passes through each stage.

A typical cyclone such as the cyclone 46 suitable for use in the practice of the process of FIG. 4 is illustrated in FIG. 5 and comprises a cylindrical housing 80 provided with a tangential inlet 82 at the upper end thereof. A vortex finder 84 is mounted centrally of the upper end of the cyclone adjacent to the inlet 82 and is connected at its upper end to a cyclone overflow discharge port 86. The lower end of the housing 80 is of a reduced conical configuration and terminates with a cyclone underflow discharge port 88 through which the washed molybdenum particles are discharged. The interior of the housing 80 is preferably provided with a liner 90 which may comprise a suitable natural or synthetic rubber material.

In order to further illustrate a typical set of operating conditions for the process and system illustrated in FIGS. 4 and 5 of the drawings, the following example is provided:

EXAMPLE III

A regular grade molybdenite concentrate feed material was employed containing 93.57% molybdenum disulfide, 5.1% insolubles, 0.178% potassium and containing 5.4% hydrocarbon oil. The concentrate was ground to provide for the stipulated degree of liberation by passing it through two stages of a vibration mill.

The countercurrent wash treatment employed four stages in accordance with the arrangement illustrated in FIG. 4 utilizing a cyclone available from Krebs Engineers of Menlo Park, Calif., Model D3BB having a diameter of three inches and a vortex finder size of ½ inch. The flow rate during operation was 25 gallons per minute at a pressure of 40 psi.

In accordance with the foregoing arrangement and conditions employing the ground concentrate feed material, the results obtained on the cyclone underflow and cyclone overflow streams from the last cyclone are set forth in Tables 8 and 9, respectively.

TABLE 8

| CYCLONE UNDERFLOW | | | | | |
|---|---|---|---|---|---|
| Distribution | | | Grade | | |
| $MoS_2$ | Insol | Potassium | $MoS_2$ | Insol | Potassium |
| 99.32 | 65.82 | 37.54 | 95.91 | 3.45 | 0.105 |

TABLE 9

| CYCLONE OVERFLOW | | | | | |
|---|---|---|---|---|---|
| Distribution | | | Grade | | |
| $MoS_2$ | Insol | Potassium | $MoS_2$ | Insol | Potassium |
| 0.68 | 34.18 | 42.46 | 23.6 | 64.6 | 2.8 |

The cyclone underflow product as set forth in Table 8 was subjected to a froth flotation extraction to remove any large contaminating mineral particles and the results are set forth in Table 10.

TABLE 10

| Concentrate | | | | | |
|---|---|---|---|---|---|
| Distribution | | | Grade | | |
| $MoS_2$ | Insol | K | $MoS_2$ | Insol | K |
| 92.62 | 17.53 | 23.38 | 98.4 | 1.01 | 0.047 |
| **Tails** | | | | | |
| Distribution | | | Grade | | |
| $MoS_2$ | Insol | K | $MoS_2$ | Insol | K |
| 6.7 | 48.3 | 34.16 | 71.08 | 27.78 | 0.686 |

The performance of the cyclone separation system based on the final upgraded and purified molybdenum disulfide product is set forth in Table 11.

TABLE 11

| Grade | | | Distribution | | |
|---|---|---|---|---|---|
| $MoS_2$ | Insol | Potassium | $MoS_2$ | Insol | Potassium |
| 98.4 | 1.01 | 0.047 | 91.99 | 11.54 | 8.77 |

A comparison of the results obtained as set forth in Table 11 with that obtained on the use of high shear agitation tanks and cylindrical settlers in accordance with the arrangement of FIG. 1 and Examples I and II, reveals the cyclone system to be somewhat of lower efficiency but nevertheless providing a purified product of acceptable quality.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A process for producing a high purity molybdenum disulfide powder which comprises the steps of providing an impure particulated molybdenite concentrate, comminuting said concentrate, if necessary, to reduce its average particle size to a point where plus 99% liberation between gangue and molybdenite particles is obtained adjusting said concentrate if necessary to contain an oily substance in an amount of about 1-10% by weight; subjecting said concentrate comprising oily agglomerates of finely divided smaller molybdenite particles to a plurality of purification treatments each comprising:

(a) forming a mixture of said concentrate with an aqueous solution to provide a solids concentration of about 1% to about 40%.

(b) subjecting said mixture to a high shear agitation to break up the molybdenite particle agglomerates and to release at least a portion of the hydrophilic particulate contaminants mechanically entrapped therein and to effect a suspension of said particulate contaminants in the liquid phase, (c) introducing the said mixture into a quiescent zone to enable reagglomeration of the molybdenite particles while retaining a substantial portion of the released said particulate contaminants in the liquid phase, (d) separating the reagglomerated said molybdenite particles in the form of a slurry from a predominant portion of the liquid phase, (e) transferring the liquid phase to a next preceding purification treatment and transferring the separated slurry of reagglomerated said molybdenite particles to a next succeeding purification treatment in countercurrent fashion;

and discarding the liquid phase as separated from the first of the plurality of said purification treatments and recovering the purified agglomerated molybdenum disulfide particles from the slurry separated from the last of the plurality of purification treatments.

2. The process as defined in claim 1, in which at least three of said plurality of purification treatments are employed.

3. The process as defined in claim 1, in which the step of comminuting said concentrate, if necessary, is performed to reduce its average particle size to less than about 15 microns.

4. The process as defined in claim 1, in which the step of forming a mixture of said concentrate with an aqueous solution is performed to provide a solids concentration of about 5% to about 15%.

5. The process as defined in claim 1, including the further step of subjecting the recovered reagglomerated said purified molybdenum disulfide particles from a last purification treatment to a supplemental froth flotation extraction operation to remove residual coarse contaminating particles therefrom.

6. The process as defined in claim 1, in which said aqueous solution employed for forming said mixture comprises water containing controlled amounts of depressant agents and wetting agents.

7. The process as defined in claim 1, in which said aqueous solution employed for forming said mixture comprises an aqueous solution containing agents for adjusting the pH of said aqueous solution to within a range of about 8 to about 9.

8. The process as defined in claim 1, in which the step (b) is performed by subjecting said mixture to high-shear agitation in a chamber incorporating a high-shear agitator.

9. The process as defined in claim 1, in which the step (b) of subjecting said mixture to high-shear agitation is performed by a high speed centrifugal pump.

10. The process as defined in claim 1, in which the step (d) of separating the reagglomerated said molybdenite particles from a predominant portion of the liquid phase is performed in a settling unit.

11. The process as defined in claim 1, in which the step (d) of separating the reagglomerated said molybdenite particles from a predominant portion of the liquid phase is performed in a cyclone.

* * * * *